US010981022B2

(12) United States Patent
Zhao et al.

(10) Patent No.: US 10,981,022 B2
(45) Date of Patent: Apr. 20, 2021

(54) SMART RESPIRATOR AND METHOD AND DEVICE FOR CALCULATING POLLUTANT ABSORPTION

(71) Applicant: Xiaomi Inc., Beijing (CN)

(72) Inventors: Tong Zhao, Beijing (CN); Qun Tao, Beijing (CN); Huayijun Liu, Beijing (CN)

(73) Assignee: Xiaomi Inc., Beijing (CN)

( * ) Notice: Subject to any disclaimer, the term of this patent is extended or adjusted under 35 U.S.C. 154(b) by 1195 days.

(21) Appl. No.: 15/138,669

(22) Filed: Apr. 26, 2016

(65) Prior Publication Data

US 2017/0028228 A1 Feb. 2, 2017

(30) Foreign Application Priority Data

Jul. 31, 2015 (CN) ..... 201510463219.X

(51) Int. Cl.
*A62B 18/00* (2006.01)
*A62B 9/00* (2006.01)
(Continued)

(52) U.S. Cl.
CPC ..... *A62B 9/006* (2013.01); *A62B 18/02* (2013.01); *A62B 18/084* (2013.01); *A62B 23/025* (2013.01)

(58) Field of Classification Search
CPC ..... A62B 9/00; A62B 9/006; A62B 18/02; A62B 18/084; A62B 18/025; A62B 18/04;
(Continued)

(56) References Cited

U.S. PATENT DOCUMENTS 4,646,732 A * 3/1987 Chien ..... A62B 18/025 128/205.12
5,372,130 A * 12/1994 Stern ..... A62B 18/006 128/205.25
(Continued)

FOREIGN PATENT DOCUMENTS

CN 103815588 A 5/2014
CN 104585922 A 5/2015
(Continued)

OTHER PUBLICATIONS

Extended Search Report for European Application No. 16166964.3 from the European Patent Office, dated Jan. 10, 2017.
(Continued)

*Primary Examiner* — Samchuan C Yao
*Assistant Examiner* — Matthew Standard
(74) *Attorney, Agent, or Firm* — Finnegan, Henderson, Farabow, Garrett & Dunner, L.L.P.

(57) ABSTRACT

A smart respirator includes a main respirator-body including a first open end and a second open end. A diameter of the first open end is smaller than a diameter of the second open end. The smart respirator further includes a front respirator-body arranged at the first open end. The front respirator-body includes a filter sheet arranged inside the front respirator-body and configured to absorb pollutants in air entering the front respirator-body, an air sensor arranged inside the front respirator-body and configured to detect an air index of filtered air filtered by the filter sheet, and a flow sensor arranged inside the front respirator-body and configured to determine a total respiratory amount. The smart respirator also includes a fixation band arranged at the second open end.

5 Claims, 6 Drawing Sheets

(51) Int. Cl.
*A62B 18/02* (2006.01)
*A62B 18/08* (2006.01)
*A62B 23/02* (2006.01)

(58) Field of Classification Search
CPC ..... A62B 18/045; A62B 18/08; A62B 18/088; A62B 23/00; A62B 23/025; A62B 23/02; A62B 19/00–02; A62B 27/00; A62B 7/00; A62B 7/10; A61M 2205/75; A61M 2205/50; A61M 2205/33–35; A61M 16/00
See application file for complete search history.

(56) References Cited

U.S. PATENT DOCUMENTS

| | | | | |
|---|---|---|---|---|
| 5,950,621 | A * | 9/1999 | Klockseth | A62B 9/006 128/204.26 |
| 6,257,235 | B1 * | 7/2001 | Bowen | A62B 23/025 128/206.12 |
| 7,860,662 | B2 * | 12/2010 | Parham | A62B 9/006 128/202.22 |
| 9,044,626 | B2 * | 6/2015 | Truex | A62B 9/006 |
| 2012/0055815 | A1 | 3/2012 | Truex et al. | |
| 2013/0139816 | A1 | 6/2013 | Proctor | |
| 2013/0327335 | A1 * | 12/2013 | Ishikawa | A62B 23/025 128/205.27 |
| 2014/0373846 | A1 | 12/2014 | Kao et al. | |
| 2015/0020800 | A1 | 1/2015 | Tobias | |

FOREIGN PATENT DOCUMENTS

| | | | |
|---|---|---|---|
| CN | 204363022 | U | 6/2015 |
| CN | 105029770 | A | 11/2015 |
| JP | 3-207425 | A | 9/1991 |
| JP | 5-49709 | A | 3/1993 |
| JP | 2002-102367 | A | 4/2002 |
| JP | 2007-502180 | A | 2/2007 |
| JP | 2008516779 | A | 5/2008 |
| JP | 2013-75157 | A | 4/2013 |
| JP | 2013-537812 | A | 10/2013 |
| JP | 2013-226209 | A | 11/2013 |
| JP | 2015501190 | A | 1/2015 |
| RU | 2349357 | C1 | 3/2009 |
| RU | 2363518 | C1 | 8/2009 |
| RU | 2555682 | C2 | 7/2015 |
| SU | 1560234 | A1 | 4/1990 |
| WO | WO 2012/118043 | A1 | 9/2012 |
| WO | WO 2015/166444 | A1 | 11/2015 |

OTHER PUBLICATIONS

Office Action dated Apr. 27, 2016, in counterpart China Application No. 201510463219.X and English translation thereof.
Supplemental earch Report dated May 23, 2016, in counterpart China Application No. 201510463219.X and English translation thereof.
Office Action issued in European Patent Application No. 16166964.3, from the European Patent Office, dated Jul. 17, 2017.
Decision on Granting a Patent for Invention issued in Russian Patent Application No. 2016110111/12(015957), from the Russian Federal Service for Intellectual Property, dated Apr. 24, 2017.
International Search Report of PCT Patent Application No. PCT/CN2015/098418, dated May 5, 2016, issued by the State Intellectual Property Office of P.R. China as ISA (5 pages).
Examination Report from the Intellectual Property of India for corresponding India Patent Application No. 201617007329 filed Feb. 20, 2019.

* cited by examiner

SMART RESPIRATOR AND METHOD AND DEVICE FOR CALCULATING POLLUTANT ABSORPTION

CROSS-REFERENCE TO RELATED APPLICATION

This application is based upon and claims priority to Chinese Patent Application No. 201510463219.X, filed on Jul. 31, 2015, the entire contents of which are incorporated herein by reference.

FIELD

The present disclosure generally relates to terminals and, more particularly, to a smart respirator and a method and device for calculating pollutant absorption.

BACKGROUND

With the development of science and technology, the pollution caused by industrial production is getting worse. The density of pollutant, such as Fine Particulate Matter (PM 2.5) or the like, in the air is increasing year by year, and people are more likely to suffer from various kinds of respiratory diseases. Since a respirator can filter the air entering the lung of a user to some extent, it can prevent the pollutant in the air, such as poisonous gas or dust, from entering into the lung. Therefore, respirators have become an important defense for people's health.

SUMMARY

In accordance with the present disclosure, there is provided a smart respirator including a main respirator-body having a first open end and a second open end. A diameter of the first open end is smaller than a diameter of the second open end. The smart respirator further includes a front respirator-body arranged at the first open end. The front respirator-body includes a filter sheet arranged inside the front respirator-body and configured to absorb pollutants in air entering the front respirator-body, an air sensor arranged inside the front respirator-body and configured to detect an air index of filtered air filtered by the filter sheet, and a flow sensor arranged inside the front respirator-body and configured to determine a total respiratory amount. The smart respirator also includes a fixation band arranged at the second open end.

Also in accordance with the present disclosure, there is provided a method for calculating a pollutant absorption quantity. The method includes detecting an air index of filtered air when a user is wearing a smart respirator, determining a total respiratory amount of the user, and sending the air index of the filtered air and the total respiratory amount to a terminal.

Also in accordance with the present disclosure, there is provided a method for calculating a pollutant absorption quantity. The method includes receiving an air index of filtered air and a total respiration amount sent by a smart respirator, acquiring a local air index, and calculating the pollutant absorption quantity according to the air index of the filtered air, the total respiratory amount, and the local air index.

It is to be understood that both the forgoing general description and the following detailed description are exemplary only, and are not restrictive of the present disclosure.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of devices and methods consistent with aspects related to the invention as recited in the appended claims.

Figure 1:
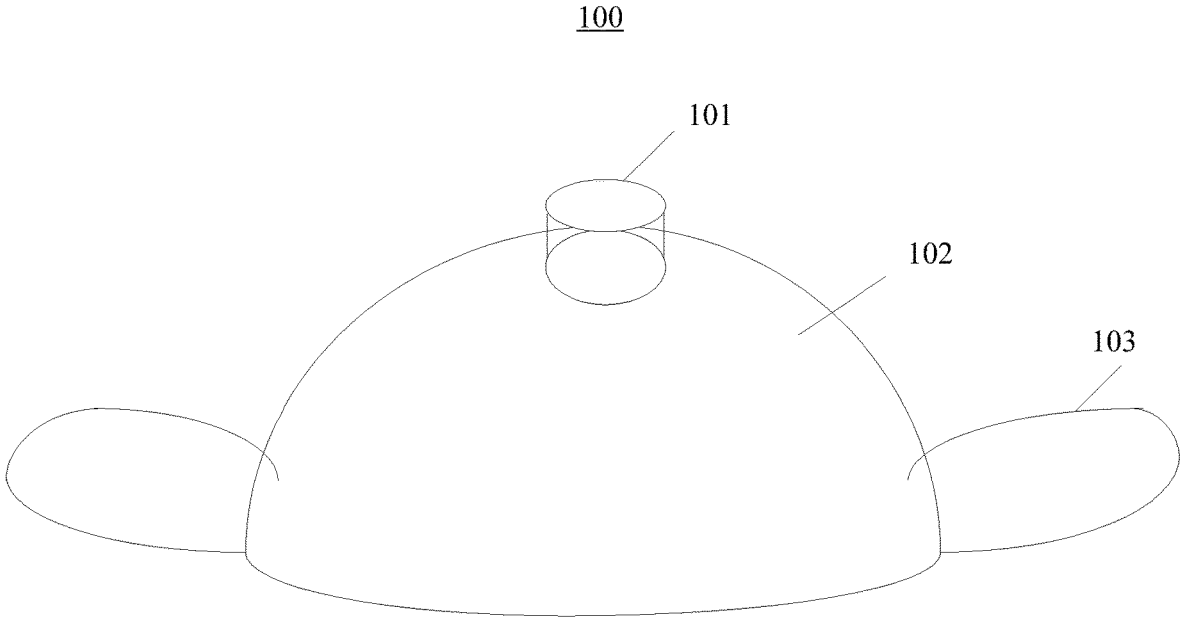
FIG. 1 is a schematic diagram showing the structure of a smart respirator according to an exemplary embodiment.

FIG. 1 schematically shows a smart respirator 100 according to the present disclosure. As shown in FIG. 1, the smart respirator 100 includes a front respirator-body 101, a main respirator-body 102, and a fixation band 103.

Figure 2A:
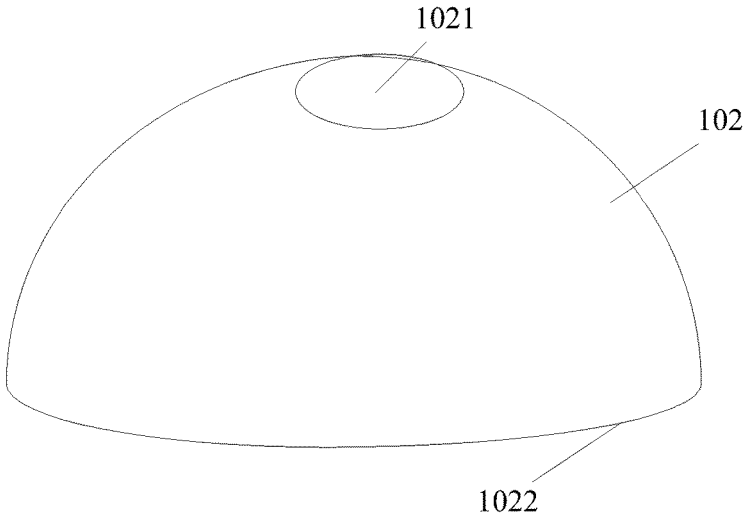
FIG. 2(A) is a schematic diagram showing the structure of a main respirator-body of the smart respirator.

FIG. 2(A) is a perspective view of the main respirator-body 102. As shown in FIG. 2(A), the main respirator-body 102 includes a first open end 1021 and a second open end 1022. The diameter of the first open end 1021 is smaller than the diameter of the second open end 1022. The front respirator-body 101 is arranged at the first open end 1021 of the main respirator-body 102, and the fixation band 103 is arranged at the second open end 1022 of the main respirator-body 102.

Figure 2B:
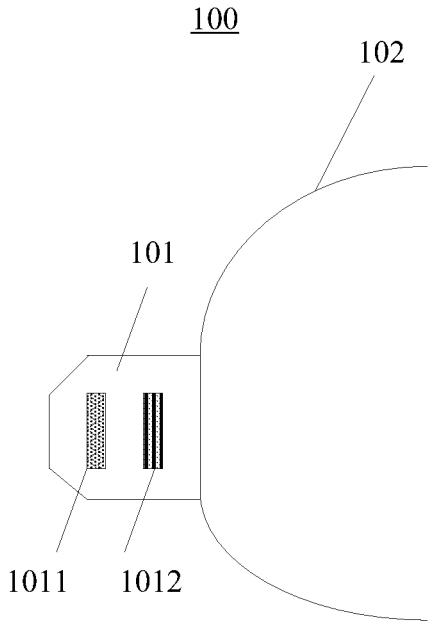
FIG. 2(B) is a schematic diagram showing a side view of a smart respirator according to another exemplary embodiment.

FIG. 2(B) is a side view of an example of the smart respirator 100. In the example shown in FIG. 2(B), filter sheets 1011 and sensors 1012 are arranged in turn inside the front respirator-body 101. The filter sheets are configured to absorb pollutants in the air entering the front respirator-body 101. The sensors 1012 include an air sensor and a flow sensor. The air sensor has a high sensitivity with respect to various kinds of pollutants, such as alcohol, smoke, ammonia, sulfide, or the like, and can be configured to detect an air index of filtered air. The flow sensor is configured to determine a total respiratory amount of the user when the user is wearing the smart respirator.

The fixation band 103 is configured to fix the smart respirator 100 on the user's mouth and nose at the second open end 1022, so that a closed cavum is formed between the main respirator-body 102 and the user's mouse and nose.

Figure 2C:
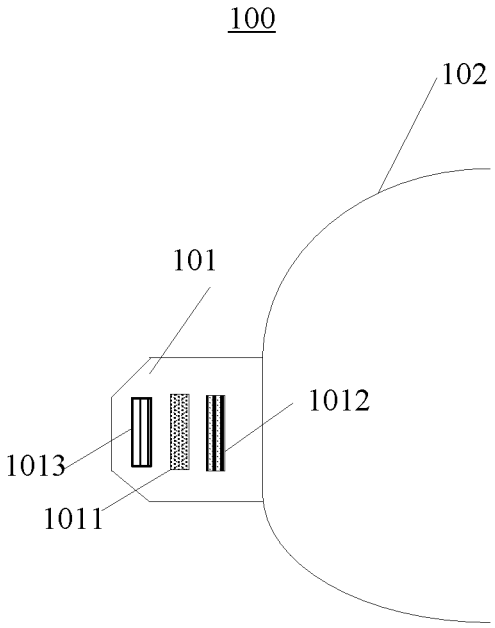
FIG. 2(C) is a schematic diagram showing a side view of a smart respirator according to another exemplary embodiment.

FIG. 2(C) is a side view of another example of the smart respirator 100. The example shown in FIG. 2(C) is similar to the example shown in FIG. 2(B), except that in the example shown in FIG. 2(C), an air exhaust device 1013 is further arranged inside the front respirator-body 101. The filter sheets 1011 are arranged between the air exhaust device 1013 and the sensors 1012. The air exhaust device 1013 can be a ventilator, a fan, or the like, and is configured to exhaust the air exhaled by the user out of the smart respirator 100.

Figure 2D:
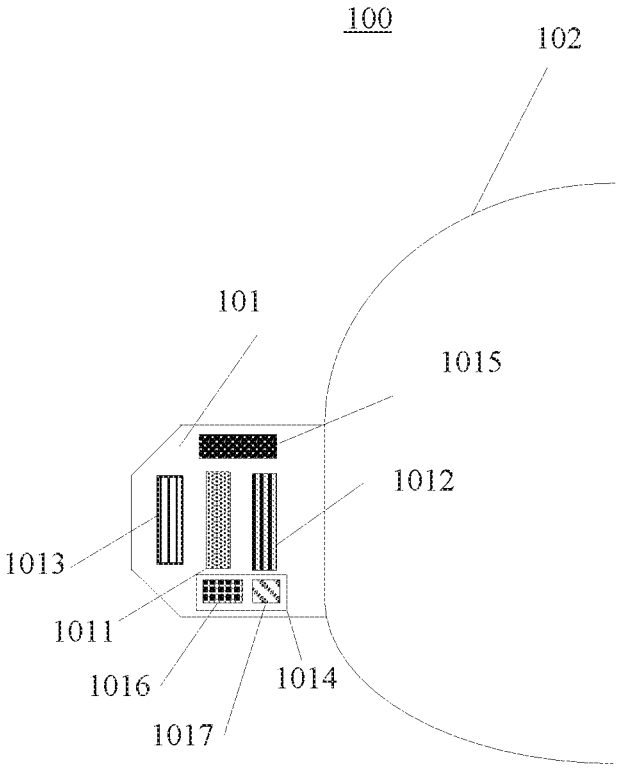
FIG. 2(D) is a schematic diagram showing a side view of a smart respirator according to another exemplary embodiment.

FIG. 2(D) is a side view of another example of the smart respirator 100. The example shown in FIG. 2(D) is similar to the example shown in FIG. 2(C), except that in the example shown in FIG. 2(D), a processor 1014 and a battery 1015 are arranged inside the front respirator-body 101. Referring to FIG. 2(D), the processor 1014 and the battery 1015 are arranged on the inner wall of the front respirator-body 101. The processor 1014 includes an integrated circuit board 1016 and a connecting module 1017. The integrated circuit board 1016 includes, for example, a Printed Circuit Board (PCB), a single-chip computer, or the like. The processor 1014 is the control center of the smart respirator 100, and is configured to, for example, control the sensors 1012 to record the time of wearing the smart respirator 100 or control the connecting module 1017 to be paired and connected with a terminal or the like. The battery 1015 is configured to, for example, supply power to the processor 1014. In some embodiments, the connecting module 1017 includes, for example, a Bluetooth module, an infrared module, or a Near Field Communication (NFC) module.

With the filter sheets 1011 and the sensors 1012 arranged in turn inside the front respirator-body 101, the smart respirator 100 can detect the air index of the filtered air and determine the user's total respiratory amount when the user is wearing the smart respirator 100.

Exemplary methods consistent with the present disclosure will be described below with respect to FIGS. 3-5. Numerals in these drawings and the description below do not indicate the order of the processes. A process having a larger numeral may be performed earlier than a process having a smaller numeral.

Figure 3:
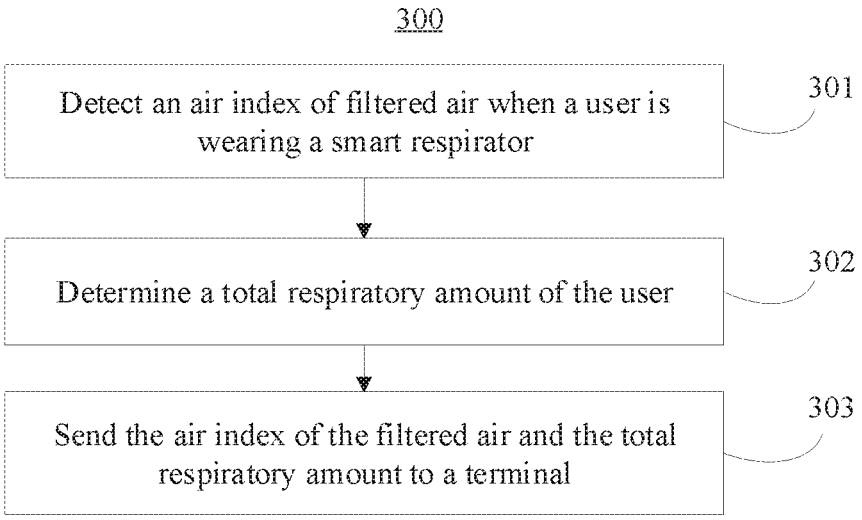
FIG. 3 is a flow chart showing a method for calculating a pollutant absorption quantity according to an exemplary embodiment.

FIG. 3 is the flow chart of a method 300 for calculating a pollutant absorption quantity according to an exemplary embodiment. The method 300 can be implemented, for example, in a smart respirator, such as one of the exemplary smart respirators 100 described above. As shown in FIG. 3, at 301, an air index of filtered air is detected when a user is wearing the smart respirator. At 302, a total respiratory amount of the user is determined. At 303, the air index of the filtered air and the total respiratory amount is sent to a terminal for the terminal to calculate the pollutant absorption quantity according to the air index of the filtered air, the total respiratory amount, and a local air index of the day when the user is wearing the smart respirator.

In some embodiments, before the air index of the filtered air and the total respiratory amount are sent to the terminal, a Bluetooth function of the smart respirator is enabled to connect to the terminal via Bluetooth signals. Alternatively, an NFC function of the smart respirator is enabled to connect to the terminal via an NFC data channel. Alternatively, an infrared function of the smart respirator is enabled to connect to the terminal via infrared signals.

In some embodiments, the alternative technical solutions described above can be combined, and the details of the combination are omitted here.

Figure 4:
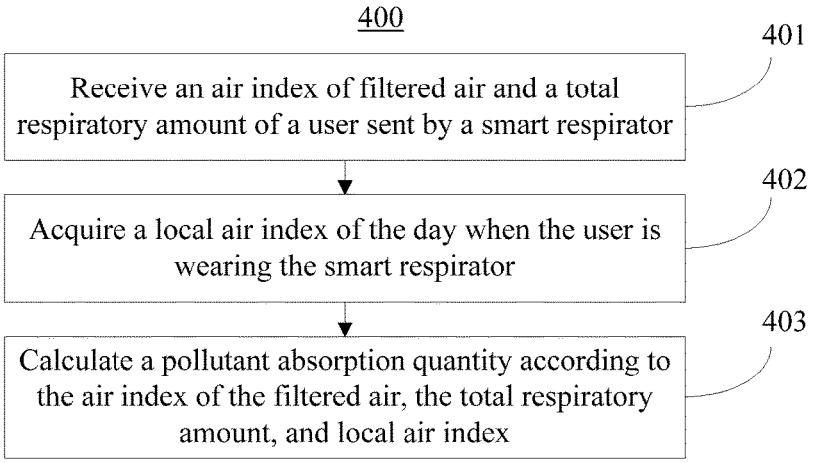
FIG. 4 is a flow chart showing a method for calculating a pollutant absorption quantity according to another exemplary embodiment.

FIG. 4 is the flow chart of a method 400 for calculating a pollutant absorption quantity according to another exemplary embodiment. The method 400 can be implemented, for example, in a terminal. As shown in FIG. 4, at 401, an air index of filtered air and a total respiration amount of a user sent by a smart respirator are received. At 402, a local air index of the day when the user is wearing the smart respirator is acquired. At 403, the pollutant absorption quantity is calculated according to the air index of the filtered air, the total respiratory amount, and the local air index.

In some embodiments, before receiving the air index of the filtered air and the total respiratory amount sent by the smart respirator, the terminal can enable a Bluetooth function to connect to the smart respirator via Bluetooth signals, enable an NFC function to connect to the smart respirator via an NFC data channel, or enable an infrared function to connect to the smart respirator via infrared signals.

In some embodiments, the terminal can acquire the local air index via the Internet or by a built-in air sensor.

In some embodiments, to calculate the pollutant absorption quantity, the terminal can calculate an air purification degree according to the local air index and the air index of the filtered air, and calculate the pollutant absorption quantity according to the total respiratory amount and the air purification degree.

In some embodiments, after calculating the pollutant absorption quantity, the terminal can upload the pollutant quantity to a server, which determines an absorption-quantity ranking according to the pollutant absorption quantities uploaded by various terminals and returns the absorption-quantity ranking to the terminals. The terminal can then receive the absorption-quantity ranking sent by the server.

All the above alternative technical solutions can be combined as needed to form alternative embodiments of the disclosure, which are not elaborated here.

Figure 5:
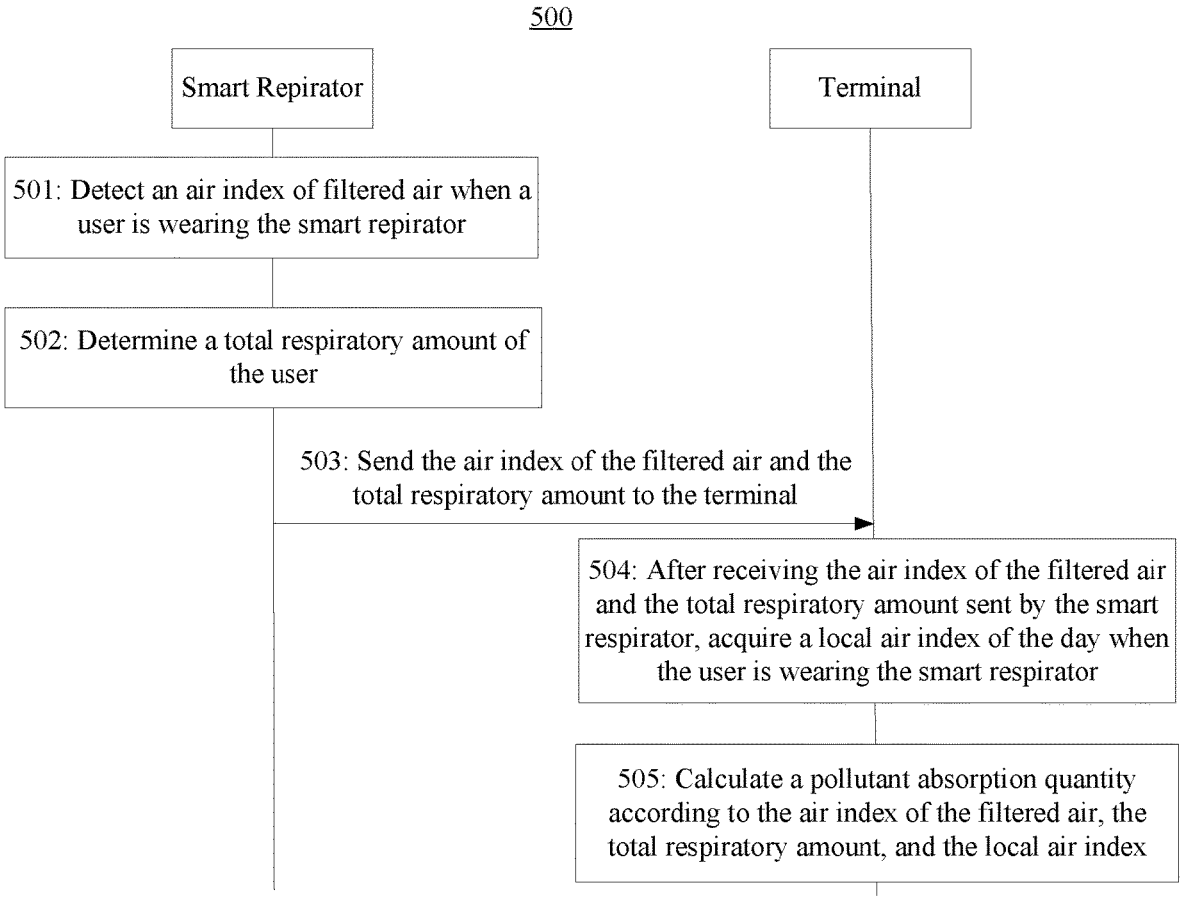
FIG. 5 is a flow chart showing a method for calculating a pollutant absorption quantity according to another exemplary embodiment.

FIG. 5 is a flow chart of a method 500 for calculating a pollutant absorption quantity according to another exemplary embodiment. The method 500 can be implemented, for example, by a terminal and a smart respirator, such as one of the exemplary smart respirators 100 described above. As shown in FIG. 5, at 501, the smart respirator detects an air index of filtered air when a user is wearing the smart respirator. In some embodiments, sensors are arranged inside a front respirator-body of the smart respirator. The sensors can include an air sensor and a flow sensor. The air sensor is configured to detect the air index of the filtered air, and the flow sensor is configured to determine a total respiratory amount when the user is wearing the smart respirator. Therefore, when the user is wearing the smart respirator, filter sheets arranged inside the smart respirator filter the air entering the smart respirator, and the air sensor in the smart respirator can detect the air index of the filtered air.

At 502, the smart respirator determines the total respiratory amount of the user, for example, by the flow sensor arranged in the smart respirator.

In some embodiments, the smart respirator detects the air index of the filtered air and determines the total respiratory amount simultaneously.

At 503, the smart respirator sends the air index of the filtered air and the total respiratory amount to the terminal. In some embodiments, a connecting module is arranged inside a processor of the smart respirator. The connecting module can be a Bluetooth module, an NFC module, an infrared module, or the like, and is used to establish a connection with the terminal, which also has a connecting function. For example, the smart respirator and the terminal enable the Bluetooth function, and discover each other in a process of device discovery. The smart respirator broadcasts a Bluetooth signal. After the terminal receives the Bluetooth signal broadcast by the smart respirator, a connection is established between the terminal and the smart respirator according to the received Bluetooth signal. As another example, the smart respirator and the terminal enable the NFC function, and an NFC channel is established by exchanging packets. Thus, the connection between the smart respirator and the terminal is established by the established NFC channel. As a further example, the smart respirator and the terminal enable the infrared function, and discover each other in a process of device discovery. The smart respirator broadcasts an infrared signal. The terminal receives the infrared signal broadcast by the smart respirator, and a connection is established between the terminal and the smart respirator according to the received infrared signal.

At 504, after receiving the air index of the filtered air and the total respiratory amount sent by the smart respirator, the terminal acquires a local air index. The air index refers to the density of fine particulate matter, sulfur dioxide, nitrogen dioxide, ozone, carbon monoxide, or the like, and is measured by microgram per stere. In some embodiments, after receiving the air index of the filtered air and the total respiratory amount sent by the smart respirator, the terminal can determine the position of the terminal via a Global Positioning System (GPS), and acquire the local air index from the Internet. The terminal can also retrieve data issued by a local observatory to acquire the local air index. The terminal can also detect the local air index over time by a built-in air sensor, store the detected air index in a database, and retrieve the local air index from the database when receiving a wearing time sent by the smart respirator.

At 505, the terminal calculates the pollutant absorption quantity according to the air index of the filtered air, the total respiratory amount, and the local air index. In some embodiments, the terminal first calculates an air purification degree according to the local air index and the air index of the filtered air. Specifically, the terminal can subtract the air index of the filtered air from the local air index to get the air purification degree, i.e., air purification degree ($mg/m^3$) =local air index ($mg/m^3$)−air index of the filtered air ($mg/m^3$). For example, if the local air index when the user wears the smart respirator is 20 $mg/m^3$, and the air index of the filtered air is 8 $mg/m^3$, then the degree of purification of the air=the local air index−the air index of the filtered air=(20-8) $mg/m^3$=12 $mg/m^3$.

Then, the terminal calculates the pollutant absorption quantity according to the total respiratory amount and the air purification degree. Specifically, the terminal can multiply the degree of purification of the air by the total respiratory amount to get the pollutant absorption quantity, i.e., pollutant absorption quantity (mg)=air purification degree ($mg/m^3$)×total respiratory amount ($m^3$)=(local air index−air index of the filtered air)×total respiratory amount. For example, if the local air index when the user wears the smart respirator is 35 $mg/m^3$, the air index of the filtered air of the air filtered by the smart respirator is 15 $mg/m^3$, and the total respiratory amount when the user is wearing the smart respirator is 10 $m^3$, then the pollutant absorption quantity= (the local air index—the air index of the filtered air)×the total respiratory capacity=(35 $mg/m^3$−15 $mg/m^3$)×10 $m^3$=200 mg.

In some embodiments, the terminal uploads the calculated pollutant absorption quantity to a server, which determines an absorption-quantity ranking according to the pollutant absorption quantities uploaded by various terminals and returns the absorption-quantity ranking to the terminal. The terminal shows the absorption-quantity ranking to the user after having received the ranking from the server so that the user can more directly appreciate the performance of the smart respirator and the status of the local air quality.

Figure 6:
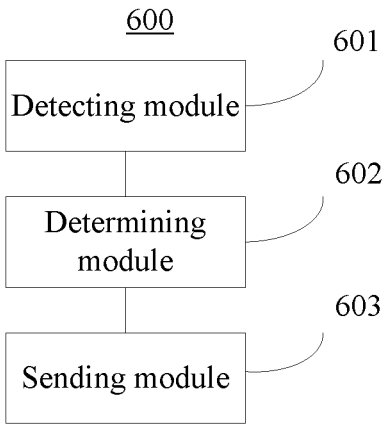
FIG. 6 is a schematic diagram of a smart respirator according to another exemplary embodiment.

FIG. 6 is a schematic diagram of a smart respirator 600 according to an exemplary embodiment. As shown in FIG. 6, the smart respirator 600 includes a detecting module 601, a determining module 602, and a sending module 603. The detecting module 601 is configured to detect an air index of filtered air when a user is wearing the smart respirator. The determining module 602 is configured to determine a total respiratory amount of the user. The sending module 603 is configured to send the air index of the filtered air and the total respiratory amount to a terminal for the terminal to calculate a pollutant absorption quantity according to the air index of the filtered air, the total respiratory capacity, and a local air index.

In some embodiments, the smart respirator 600 further includes a connecting module configured to enable a Bluetooth function to connect to the terminal via Bluetooth signals, to enable an NFC function to connect to the terminal via an NFC data channel, or to enable an infrared function to connect to the terminal via infrared signals.

Figure 7:
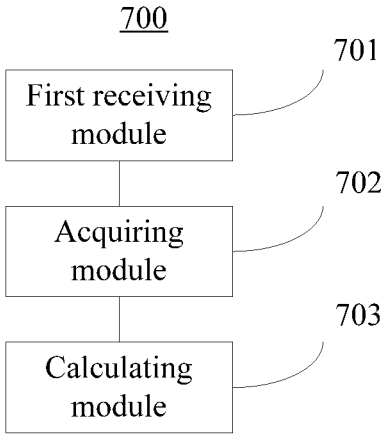
FIG. 7 is a schematic diagram of a device for calculating a pollutant absorption according to an exemplary embodiment.

FIG. 7 is the schematic diagram of a device 700 for calculating a pollutant absorption quantity according to an exemplary embodiment. As shown in FIG. 7, the device 700 includes a first receiving module 701, an acquiring module 702, and a calculating module 703. The first receiving module 701 is configured to receive an air index of filtered air and a total respiration amount of a user sent by a smart respirator. The acquiring module 702 is configured to acquire a local air index of the day when the user is wearing the smart respirator. The calculating module 703 is configured to calculate the pollutant absorption quantity according to the air index of the filtered air, the total respiratory amount, and the local air index.

In some embodiments, the device 700 further includes a connecting module (not shown) configured to enable a Bluetooth function to connect to the smart respirator via Bluetooth signals, to enable an NFC function to connect to the smart respirator via a NFC data channel, or to enable an infrared function to connect to the smart respirator via infrared signals.

In some embodiments, the acquiring module 702 is configured to acquire the local air index via the Internet or by a built-in air sensor.

In some embodiments, the calculating module 703 is configured to calculate an air purification degree according to the local air index and the air index of the filtered air, and calculate the pollutant absorption quantity according to the total respiratory amount and the air purification degree.

In some embodiments, the device 700 further includes an uploading module (not shown) and a second receiving module (not shown). The uploading module is configured to upload the pollutant quantity to a server, which determines an absorption-quantity ranking according to pollutant absorption quantities uploaded by various terminals and returns the ranking of the absorption. The second receiving module is configured to receive the absorption-quantity ranking sent by the server.

Operations of the above-described exemplary devices are similar to the exemplary methods described above, and thus their detailed description is omitted here.

Figure 8:
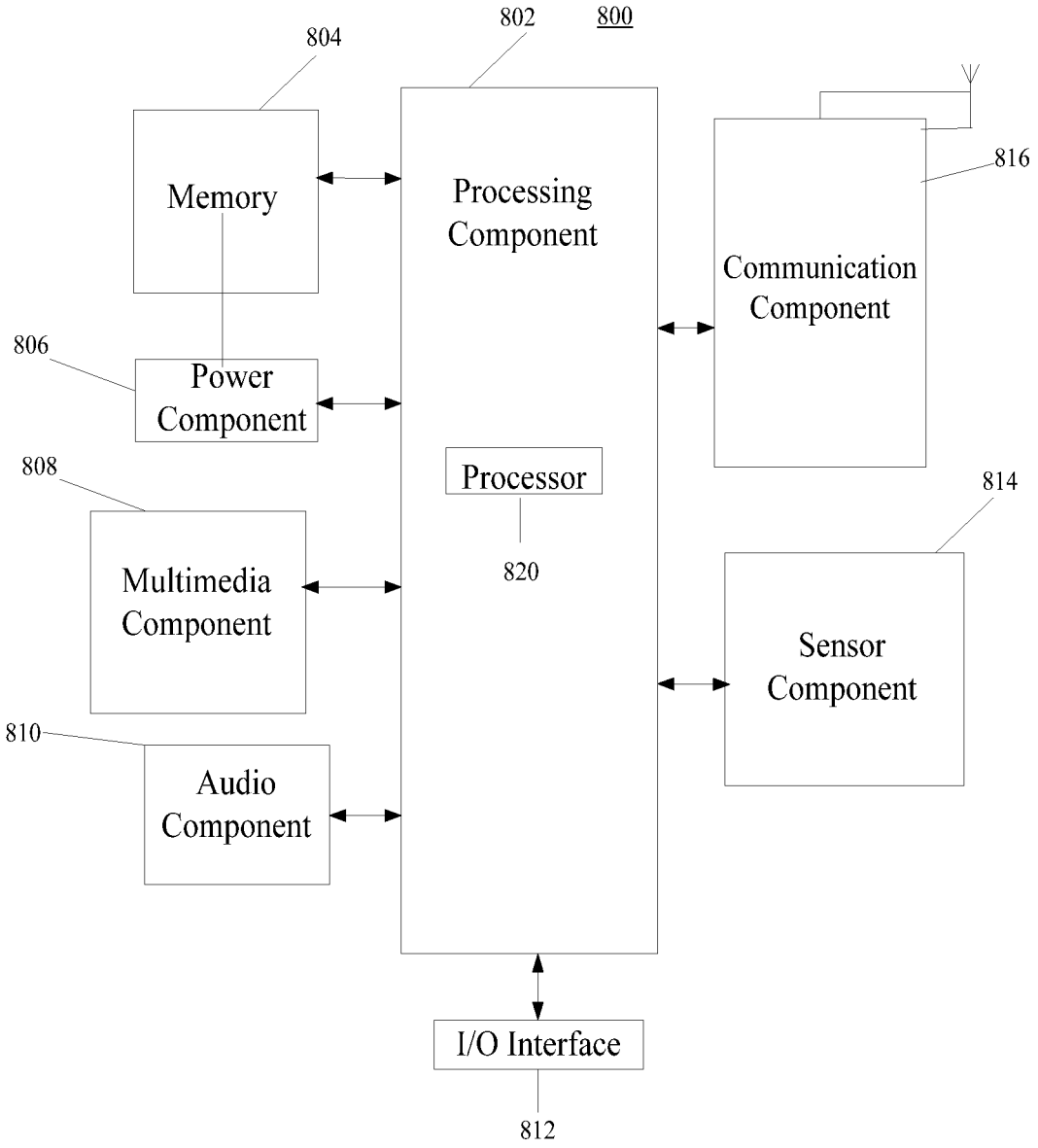
FIG. 8 is a block diagram showing a device for calculating a pollutant absorption quantity according to another exemplary embodiment.

FIG. 8 is a block diagram of a device 800 for calculating a pollutant absorption quantity according to another exemplary embodiment. For example, the device 800 may be a mobile phone, a computer, a digital broadcast terminal, a messaging device, a gaming console, a tablet, a medical device, exercise equipment, a personal digital assistant, or the like.

Referring to FIG. 8, the device 800 includes one or more of the following components: a processing component 802, a memory 804, a power component 806, a multimedia component 808, an audio component 810, an input/output (I/O) interface 812, a sensor component 814, and a communication component 816.

The processing component 802 typically controls overall operations of the device 800, such as the operations associated with display, telephone calls, data communications, camera operations, and recording operations. The processing component 802 may include one or more processors 820 to execute instructions to perform all or part of a method consistent with the present disclosure, such as one of the above-described exemplary methods. Moreover, the processing component 802 may include one or more modules which facilitate the interaction between the processing component 802 and other components. For example, the processing component 802 may include a multimedia module to facilitate the interaction between the multimedia component 808 and the processing component 802.

The memory 804 is configured to store various types of data to support the operation of the device 800. Examples of such data include instructions for any applications or methods operated on the device 800, contact data, phonebook data, messages, pictures, video, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 806 provides power to various components of the device 800. The power component 806 may include a power management system, one or more power sources, and any other components associated with the generation, management, and distribution of power in the device 800.

The multimedia component 808 includes a screen providing an output interface between the device 800 and the user. In some embodiments, the screen may include a liquid crystal display (LCD) and a touch panel. If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 808 includes a front camera and/or a rear camera. The front camera and the rear camera may receive an external multimedia datum while the device 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone configured to receive an external audio signal when the device 800 is in an operation mode, such as a call mode, a recording mode, and a voice recognition mode. The received audio signal may be further stored in the memory 804 or transmitted via the communication component 816. In some embodiments, the audio component 810 further includes a speaker to output audio signals.

The I/O interface 812 provides an interface between the processing component 802 and peripheral interface modules, such as a keyboard, a click wheel, buttons, and the like. The buttons may include, but are not limited to, a home button, a volume button, a starting button, and a locking button.

The sensor component 814 includes one or more sensors to provide status assessments of various aspects of the device 800. For example, the sensor component 814 may detect an open/closed status of the device 800, relative positioning of components, e.g., the display and the keypad, of the device 800, a change in position of the device 800 or a component of the device 800, a presence or absence of user contact with the device 800, an orientation or an acceleration/deceleration of the device 800, and a change in temperature of the device 800. The sensor component 814 may include a proximity sensor configured to detect the presence of nearby objects without any physical contact. The sensor component 814 may also include a light sensor, such as a CMOS or CCD image sensor, for use in imaging applications. In some embodiments, the sensor component 814 may also include an accelerometer sensor, a gyroscope sensor, a magnetic sensor, a pressure sensor, or a temperature sensor.

The communication component 816 is configured to facilitate communication, wired or wirelessly, between the device 800 and other devices. The device 800 can access a wireless network based on a communication standard, such as WiFi, 2G, 3G, or 4G, or a combination thereof. In one exemplary embodiment, the communication component 816 receives a broadcast signal or broadcast associated information from an external broadcast management system via a broadcast channel. In one exemplary embodiment, the communication component 816 further includes a Near Field Communication (NFC) module to facilitate short-range communications. For example, the NFC module may be implemented based on a radio frequency identification (RFID) technology, an infrared data association (IrDA) technology, an ultra-wideband (UWB) technology, a Bluetooth technology, or another technology.

In exemplary embodiments, the device 800 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, configured to perform a method consistent with the present disclosure, such as one of the above-described exemplary methods.

In exemplary embodiments, there is also provided a non-transitory computer-readable storage medium including instructions, such as included in the memory 804, executable by the processor 820 in the device 800, for performing a method consistent with the present disclosure, such as one of the above-described exemplary methods. For example, the non-transitory computer-readable storage medium may be a ROM, a RAM, a CD-ROM, a magnetic tape, a floppy disc, an optical data storage device, or the like.

According to the present disclosure, filter sheets and sensors are arranged in turn inside a front respirator-body of a smart respirator, such that the smart respirator can absorb pollutants in air and detect an air index of the filtered air. When a user is wearing the smart respirator, the smart respirator can determine a total respiratory capacity. A pollutant absorption quantity is calculated according to the air index of the filtered air. The total respiratory capacity and the local air index, and thus the local air condition can be presented to the user more directly.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A smart respirator, comprising:

a main respirator-body including a first open end and a second open end, a diameter of the first open end being smaller than a diameter of the second open end;

a front respirator-body arranged at the first open end and including:

a filter sheet arranged inside the front respirator-body and configured to absorb pollutants in air entering the front respirator-body;

an air sensor arranged inside the front respirator-body and configured to detect an air index of filtered air filtered by the filter sheet; and a flow sensor arranged inside the front respirator-body and configured to determine a total respiratory amount; and a fixation band arranged at the second open end, wherein the front respirator-body further includes:

an air exhaust device arranged inside the front respirator-body and configured to exhaust air, the filter sheet being arranged between the air exhaust device and a group of sensors including the air sensor and the flow sensor, and a processor arranged inside the front respirator-body, wherein the processor includes a connecting module configured to transmit the air index of filtered air and the total respiratory amount to a terminal, for the terminal to calculate an air purification degree based on a subtraction of the air index of the filtered air from a local air index obtained from the Internet, and to calculate a pollutant absorption quantity based on the air purification degree and the total respiratory amount.

2. The smart respirator of claim 1, wherein the air exhaust device includes at least one of a ventilator or a fan.

3. The smart respirator of claim 1, wherein the processor further includes an integrated circuit board including at least one of a printed circuit board or a single-chip computer; and the front respirator-body further includes a battery configured to supply power to the processor.

4. The smart respirator of claim 3, wherein the processor and the battery are arranged on an inner wall of the front respirator-body.

5. The smart respirator of claim 1, wherein the connecting module includes one of a wireless communication module, an infrared module, or a Near Field Communication module.

* * * * *